United States Patent [19]

Longworth

[11] 4,280,400

[45] Jul. 28, 1981

[54] FUME CUPBOARDS

[76] Inventor: Archibald L. Longworth, Mirador, Woodbrook Rd., Alderley Edge, Cheshire, England

[21] Appl. No.: 42,666

[22] Filed: May 25, 1979

[30] Foreign Application Priority Data

May 30, 1978 [GB] United Kingdom ..... 24508/78

[51] Int. Cl.[3] ..... F23J 11/00

[52] U.S. Cl. ..... 98/115 LH

[58] Field of Search ..... 98/115 R, 115 LH; 55/DIG. 18

[56] References Cited

U.S. PATENT DOCUMENTS

| | | | |
|---|---|---|---|
| 2,702,505 | 2/1955 | Nelson | 98/115 LH |
| 3,000,292 | 9/1961 | Wojan | 98/115 LH |
| 3,217,630 | 11/1965 | Katzfey et al. | 98/115 LH |
| 3,218,953 | 11/1965 | Grow et al. | 98/115 LH |
| 3,318,227 | 5/1967 | Ne lson et al. | 98/115 LH |
| 3,340,788 | 9/1967 | Landingham | 98/115 LH |
| 4,134,331 | 1/1979 | Behder | 98/115 LH |

*Primary Examiner*—Albert J. Makay
*Assistant Examiner*—Harold Joyce
*Attorney, Agent, or Firm*—Sughrue, Mion, Zinn, Macpeak and Seas

[57] ABSTRACT

A fume cupboard which comprises a ventilated enclosure provided with an access opening. A cowling is provided along at least one edge of the opening, the cowling being spaced from the edge so that air flow channel is defined between the edge and the cowling. Additionally the cowling is shaped so that there is streamlined air flow over the cowling when the enclosure is being ventilated. The cowling improves containment of the fume cupboard. Additionally disclosed is a fume cupboard provided with baffles defining air exit parts, slots or the like, to improve containment. A fume cupboard having a combination of an edge cowling and baffles is also disclosed.

11 Claims, 5 Drawing Figures

FUME CUPBOARDS

BACKGROUND OF THE INVENTION

The present invention relates to fume cupboards, ventilated cupboards, ventilated cabinets, ventilated hoods and like apparatus (hereinafter collectively referred to as fume cupboards) used for providing aerial containment of gases, vapours, dusts, bacteria and other materials, for example in chemical laboratories.

A fume cupboard is a ventilated enclosure within which operations may be conducted for the purpose of avoiding release of toxic material or the like into a room in which people may be working. The fume cupboard has a fan for drawing air and toxic material from the enclosure for safe discharge, usually to atmosphere, and is also provided with an opening which allows access to the enclosure and through which air is supplied to replace that withdrawn by the fan. A problem with such cupboards however is that the flow of air through the cupboard is not streamlined and eddies are formed, particularly at corners of the cupboard and in the region of the edges of the opening, which results in air and hence toxic material, being supplied back through the opening of the cupboard, which is obviously undesirable. It is found that increasing the velocity of air entering the cupboard through the opening helps, to a certain extent, to improve containment and, in this respect, there are recommended air velocities at which cupboards should operate to provide adequate containment. However, simply increasing the air velocities to improve containment is not satisfactory, since above a particular velocity it may be found that containment is actually poorer than at lower velocities. Additionally the use of high air velocities means that more air must be drawn from the room in which the cupboard is situated. Obviously, this increases the heating costs for maintaining the room air at a suitable temperature, particularly in winter.

SUMMARY OF THE INVENTION

It is an object of the present invention to provide a fume cupboard with improved containment.

According to the present invention there is provided a fume cupboard comprising a ventilated enclosure having an access opening, and a cowling provided at an edge of the opening, said cowling being spaced from said edge so that an airflow channel is defined between the edge and the cowling and said cowling being shaped so that there is streamlined air-flow over the cowling into the enclosure, when the cupboard is in use.

Preferably such a cowling is provided along each edge of the opening. In the case where a closure member, such as a sash window, is provided for at least partially closing the access opening, and edge of the opening is clearly provided by the closure member and the cowling may be provided thereon.

The cowling serves a dual function. Firstly, the airflow channel directs a stream of air into the enclosure along the adjacent internal surface of the enclosure, thereby opposing forward flow of material out of the cupboard.

Secondly, the shape of the cowling is such that the layers or streamlines of the air-flow over the cowling are smooth and substantially free of eddies (i.e. the flow is streamlined), thereby avoiding backflow. This avoidance of backflow ensures that any material in the vicinity of the cowling is direct in the streamlined air-flow into the enclosure thereby providing a further improvement in containment.

Numerous cross-sectional shapes are possible for the cowling. The cowling should be convex to the streamline air-flow and preferably has a convex section which overhangs the edge on which the cowling is mounted and a plane or slightly curved section which extends through the opening into the enclosure. An example of such a cowling is one of aerofoil cross-section.

In accordance with a second aspect of the invention there is provided a fume cupboard comprising a ventilated enclosure and baffles within the enclosure providing air exit apertures, ports, slots or the like.

Preferably the air exit apertures are elongate and are preferably defined around the edges of the baffles. In other words, the slots are preferably defined between an edge of the baffle and either a wall of the enclosure or with another baffle.

It is found that the provision of air slots, ports or apertures, in accordance with the invention substantially improves containment of a fume cupboard by suppressing recirculating eddies which would otherwise be present. It is possible for the present invention to be applied to the modification of an existing fume cupboard so as to increase its containment.

Particularly advantageous results are obtained when a fume cupboard provided with baffles as described above, is also provided with one or more cowlings as described above.

BRIEF DESCRIPTION OF THE DRAWINGS

The invention will be further described by way of example with reference to the accompanying drawings. in which FIG. 1 diagrammatically illustrates eddies within a fume cupboard.

DETAILED DESCRIPTION OF THE INVENTION

Figure 1:
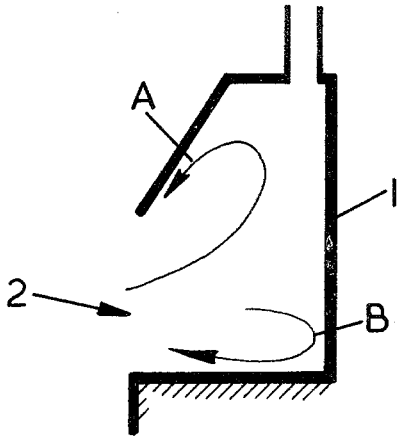

FIG. 1 illustrates troublesome eddies within a typical fume cupboard 1. The principal eddies are;

(i) an eddy A above the level of the opening 2 of the cupboard 1 producing a downflow of air from the top of the cupboard over the internal surface of the cupboard front;

(ii) an eddy B on a horizontal axis across the back of the cupboard at low level causing a forward movement of air towards the opening of the cupboard; and (iii) further eddies (not shown) on a vertical axis at both sides of the cupboard producing a forward flow of air along the side walls directed towards the opening.

Figure 2:
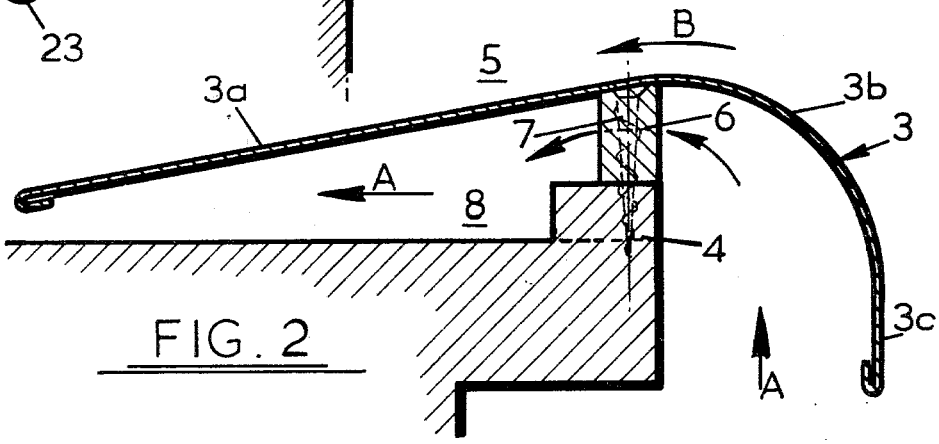
FIG. 2 shows a sectional view of a lower sill of a fume cupboard in accordance with the first aspect of the invention.

FIG. 2 illustrates the use of a cowling 3 as applied to the lower edge or sill, 4 of the opening of the working enclosure 5 of a fume cupboard. The fume cupboard is of the type in which a sash window (not shown) serves to close the opening when required.

The cowling 3 is of generally aerofoil section and comprises a plane portion 3*a* extending downward into the enclosure 5, an arcuate portion 3*b* overhanging the sill 4 and a further plane section 3*c* extending from the rounded section 3*b*. The cowling 3 is located on spacers 6 and is affixed to the sill 4 by screws 7. With the cowling 3 mounted in this or a similar way, an air flow channel 8 is defined between the edge 4 and cowling 3.

When the cupboard is in use, a fan (not shown) will withdrawn air from the enclosure 5 and hence air will be supplied into the cupboard not only directly through the opening but also along arrow A through the air channel 8. Also there will be a streamlined air-flow along arrow B over the upper surface of the cowling 3. The air-flow A is directed along the base of the fume cupboard so as to contain foward moving eddies located near the base. Additionally, material falling downwards to the lower sill 4 meets the inclined portion 3*a* of the cowling 3 and tends to "fall" back into the cupboard, this process being aided by air-flow B.

The cowling illustrated in FIG. 2 may also be used along the two side vertical edges of the opening in which case the sash window must be fabricated so as to slide over the side cowlings. Also in this case, the plane section, 3*a* will be directed to the associated side wall of the cupboard. A suitable cowling for use along the lower edge of the sash window is also generally similar to that illustrated in FIG. 2 but the plane portion 3*c* is omitted and the plane portion 3*a* is fabricated so as to parallel to the base of the fume cupboard, and not inclinded as in FIG. 2. The method of mounting side and upper cowlings is the same or similar to that for the lower cowling 3. The provision of cowlings along all four edges of the opening is particularly preferred in the order that containment problems at any one edge may be avoided.

Cowlings of the above described type may be conveniently produced from sheet metal or plastics material.

Figure 3:
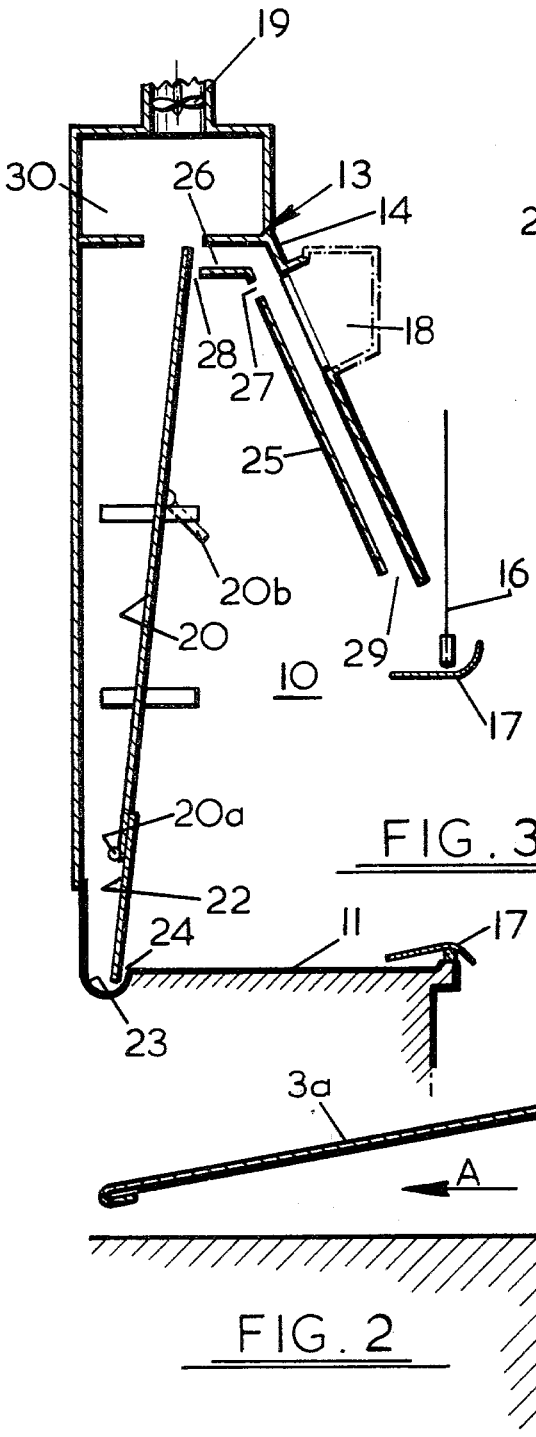
FIG. 3 shows a diagrammatic sectional view of a fume cupboard in accordance with the second aspect of the invention.
Figure 5:
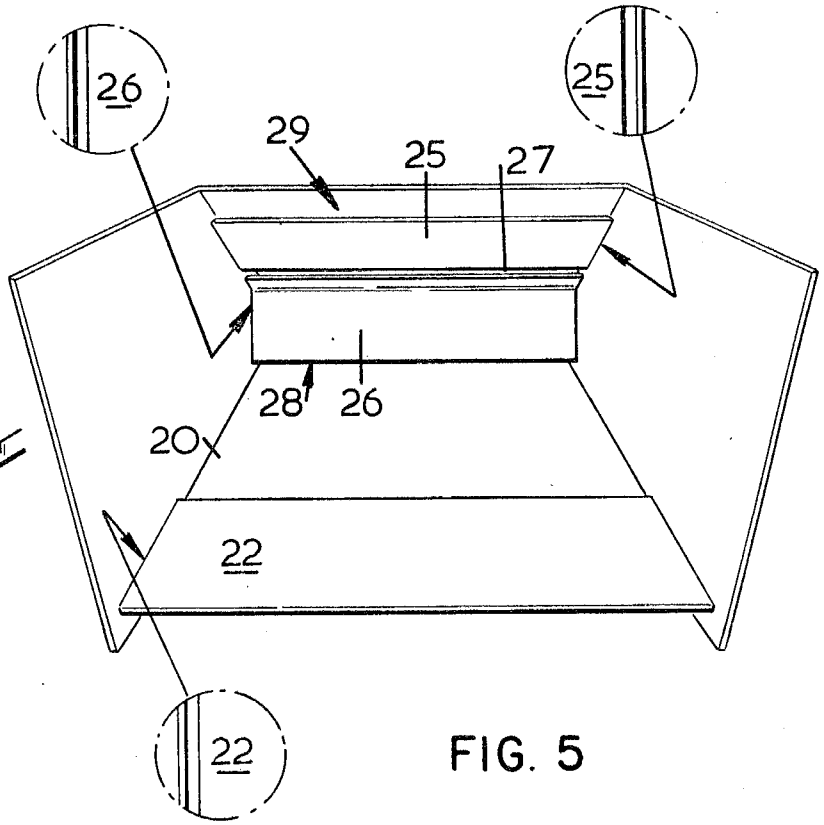
FIG. 5 shows a perspective view of the interior of the fume cupboard of FIG. 3 from below.
Figure 4:
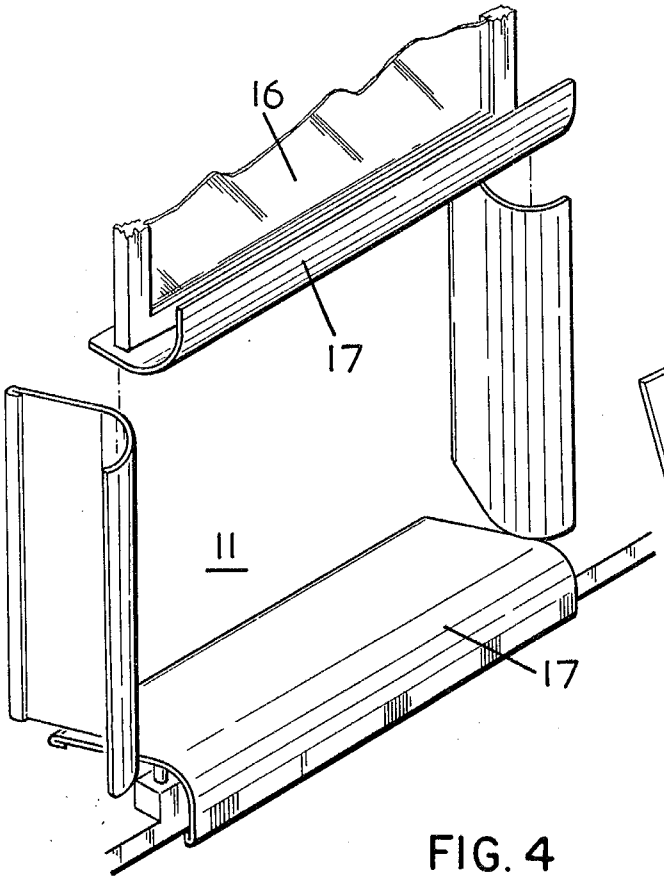
FIG. 4 shows a perspective view of the opening into the fume cupboard of FIG. 3.

FIGS. 3, 4 and 5 illustrate a fume cupboard in accordance with the second aspect of the invention. The working enclosure 10 of the fume cupboard is defined by a base 11, a rear wall 12, a ceiling 13, an inclined upper inner wall 14 and side walls (not shown). The fume cupboard has a front opening 15 which is closable by a sash window 16. It will be seen that cowlings 17, of the type described above, are provided for the edges of the opening 15.

Additionally a light is provided in a glassfronted enclosure 18 in the region of the wall 14 and there is further provided a fan 19 for ventilating the fume cupboard.

Within the fume cupboard is provided a pivotably mounted back baffle 20, of the type already known for use in improving air-flow within fume cupboards. The baffle 20 is pivoted at 20*a* and is movable by a handle 20*b* so as to vary the amount of air exiting from the cupboard via the front and rear sides of the baffle 20.

The baffle 20 locates with clearance between the side walls of the fume cupboard thereby defining air exit slots through which air may exit from the working enclosure 10 of the cupboard. It is preferred that the side edges of the baffle 20 are stepped half way along their length so that the air slot is of greater width over the lower half of the baffle 20 than over the upper half.

An extension skirt 22 is provided on the baffle and extends into a channel 23 in the fume cupboard thereby providing an air slot 24. The skirt 22 is removable to allow cleaning of the channel 23.

Additionally an upper baffle 26 and an inclined light-transparent baffle 25 parallel to the wall 14 are provided in the fume cupboard. The baffles 25 and 26 are supported on struts or the like, not shown, and each locate with clearance between the side walls of the cupboards so that air exit slots (not shown) are defined between each side edge of the baffles 25 and 26 and the adjacent side walls of the fume cupboard. Additional air exit slots include an air slot 27 defined between the edges of the baffles 25 and 26, an air slot 28 defined between the edge of baffle 26 and the back baffle 20, an air slot 29 defined between the lower edge of the baffle 25 and the wall 14.

When the fan 19 is operated a negative plenum is established at 30 and air from the working enclosure 10 flows into the negative plenum through all of the air slots provided in the fume cupboard. The air slots 24 and 27-29 defined by the arrangement of baffles 20, 25, and 26 serve to suppress recirculating eddies such as those described above which would otherwise form in the corners and angles of the fumes cupboard and therefore the efficiency of containment of the fume cupboard is increased. Although not illustrated, it is preferred that each of the baffles 20, 25 and 26 have their corners cut away to define quadrants thereby to provide an increased area of air slot to ensure a further improvement in containment. Additionally it is possible for the back baffle 20 to be mounted in a fixed attitude, rather than being pivotal as described above.

The above described arrangement of baffles is the preferred arrangement for a fume cupboard of the type illustrated. However, certain variations may be made, for example the baffle 25 need not be parallel with the wall 14.; the baffle 26 may be omitted and baffle 25 inclined so as almost to meet baffle 20 (clearance being allowed for forming an air slot).

In the case of another common type of fume cupboard in which the inner wall 14 is vertical, it is preferred that baffle 25 is also vertical and baffle 26 is extended so as to provide a narrow slot between the two baffles.

What is claimed is:

1. A fume cupboard comprising a ventilated enclosure having an access opening having an edge, a cowling located over said edge and spaced therefrom so that an air-flow channel is defined between the cowling and the edge, through which air-flow channel air may be drawn during use of the cupboard from the exterior to the interior of the enclosure, said cowling being shaped such that there is a streamlined air flow over the cowling into the enclosure when the cupboard is in use, and said cowling having a portion extending into the cupboard, the streamlined air-flow over said portion being divergent relative to the main air-flow into the enclosure through the access opening, wherein said cowling is provided along one or more of the side edges or basal edge of the access opening, the upper edge of the access opening being provided with a further cowling located over said upper edge and spaced therefrom, so that an air-flow channel is defined between said further cowling and the upper edge through which air-flow channel air may be drawn, during use of the cupboard, from the exterior to the interior of the enclosure, said further cowling having a portion which extends through said opening into the enclosure in a plane parallel to the base of the fume cupboard, and said further cowling being shaped so that there is a streamlined air flow over the cowling into the enclosure when the cupboard is in use and wherein said further cowling is provided on the lower edge of a sash window of the fume cupboard.

2. A fume cupboard as claimed in claim 1 wherein the cowling is provided along a basal edge of the access opening.

3. A fume cupboard as claimed in claim 1 wherein the access opening has two side edges and each side edge is provided with a said cowling.

4. A fume cupboard as claimed in claim 1 wherein said cowling is of aerofoil section.

5. A fume cupboard comprising a ventilated enclosure having an access opening having a top edge, a cowling located over said edge and spaced therefrom so that an air-flow channel is defined between the cowling and the edge through which air-flow channel air may be drawn during use of the cupboard, from the exterior to the interior of the enclosure, said cowling having a portion which extends through said opening into the enclosure in a plane parallel to the base of the fume cupboard, and said cowling being shaped so that there is a streamlined air flow over the cowling into the enclosure when the cupboard is in use, and wherein said opening is closable by a sash window and said cowling is provided along the bottom edge of the sash window.

6. A fume cupboard comprising a working enclosure with a rear wall, side walls, a ceiling, a floor and an access opening, a back baffle located in front of the rear wall and having its side and lower edges defining air-exit slots with the interior of the enclosure, a front baffle located rearwardly of the front wall, said front baffle having side edges defining air exit slots with the side walls of the enclosure, an upper edge providing an upper air slot, and a lower edge defining, with said front wall, a lower air slot above the access opening.

7. A fume cupboard as claimed in claim 6 wherein said front baffle is substantially parallel to the front wall of the enclosure, and further including an upper baffle, said upper baffle defining said upper air exit slot with said upper edge of said front baffle, and said upper baffle defining further air exit slots between its side edges and the side walls of the enclosure, and between its rear edge and the back baffle.

8. A fume cupboard as claimed in claim 6 wherein said rear baffle has a portion extending into a trough along the rear of the floor of the enclosure.

9. A fume cupboard as claimed in claim 8 wherein said portion of said rear baffle is a detachable skirt.

10. A fume cupboard as claimed in claim 6 wherein there is provided along an edge of the access opening, a cowling, located over said edge and spaced therefrom, so that an air-flow channel is defined between the cowling and the edge through which air-flow channel air may be drawn during use of the cupboard, from the exterior to the interior of the enclosure, said cowling being shaped so that there is a streamlined air flow over the cowling into the enclosure when the cupboard is in use, said cowling having a downwardly sloped portion extending into the cupboard so that the streamlined air-flow over said portion is divergent relative to the main air-flow into the enclosure through the access opening.

11. A fume cupboard as claimed in claim 6 wherein there is provided along an upper edge of the access opening, a further cowling, located over said edge and spaced therefrom, so that an air-flow channel is defined between the further cowling and the edge through which air-flow channel air may be drawn during use of the cupboard, from the exterior to the interior of the enclosure, said further cowling having a portion which extends through said opening into the enclosure in a plane parallel to the base of the fume cupboard, said further cowling being shaped so that there is a streamlined air flow over the cowling into the enclosure when the cupboard is in use.

* * * * *